US006109363A

United States Patent [19]

High

[11] Patent Number: 6,109,363

[45] Date of Patent: Aug. 29, 2000

[54] BLADE ASSEMBLY WITH ANGULAR MOVEMENT CAPABILITY

[75] Inventor: Bradley R. High, Sanford, N.C.

[73] Assignee: Caterpillar S.A.R.L., Geneva, Switzerland

[21] Appl. No.: 09/322,434

[22] Filed: May 28, 1999

[51] Int. Cl.[7] ..... E02F 3/76

[52] U.S. Cl. ..... 172/820; 37/234

[58] Field of Search ..... 172/817, 820, 172/819, 818, 811; 37/234, 232, 231

[56] References Cited

U.S. PATENT DOCUMENTS

| | | | |
|---|---|---|---|
| 2,088,564 | 8/1937 | Anthony et al. | 37/144 |
| 2,854,766 | 10/1958 | Miller | 37/42 |
| 3,631,930 | 1/1972 | Peterson | 172/804 |
| 3,670,825 | 6/1972 | Asal et al. | 172/805 |
| 4,216,833 | 8/1980 | Fezatt et al. | 172/805 |
| 4,217,963 | 8/1980 | Freese et al. | 172/804 |
| 4,221,267 | 9/1980 | Asal et al. | 172/804 |
| 4,248,311 | 2/1981 | Frisbee et al. | 172/819 |
| 4,253,529 | 3/1981 | Nissen | 172/831 |
| 4,324,055 | 4/1982 | Hippensteel et al. | 37/42 VL |
| 5,058,685 | 10/1991 | Moffitt | 172/820 |
| 5,165,191 | 11/1992 | Davis | 37/117.5 |
| 5,447,204 | 9/1995 | Asal et al. | 172/821 |

*Primary Examiner*—Christopher J. Novosad
*Attorney, Agent, or Firm*—Diana L. Charlton

[57] ABSTRACT

The present invention includes an angle blade assembly capable of angular motion relative to a frame of a work machine. The angle blade assembly includes a blade assembly, a subframe connected to the blade assembly, and an actuating cylinder with a line of action. The subframe includes connecting and lever portions that are connected to define a primary vertical axis. The actuating cylinder is connected to the connecting and lever portions so that a secondary vertical axis is defined between the actuating cylinder and the lever portion. The connection of the actuating cylinder to the connecting and lever portions produces the angular motion of the blade assembly when the actuating cylinder is operated. During the angular motion of the blade assembly, the secondary vertical axis moves about the primary vertical axis and a substantially constant distance is maintained between the line of action of the actuating cylinder and a parallel line extending through the primary vertical axis. The use of a single actuating cylinder in the described manner to produce angular motions of the blade assembly increases the efficiency of the design while lowering associated costs.

15 Claims, 11 Drawing Sheets

322
352
340
760
368
334
770
174
764
654
152
680
628
690
216
604
688
326
704
494
364
330
300
304
514
256
252
258
254
250
601
210
310
600
318
602
454
240
590
574
472
578
594

BLADE ASSEMBLY WITH ANGULAR MOVEMENT CAPABILITY

TECHNICAL FIELD

This invention relates generally to a blade assembly mounted on a frame of a work machine. More particularly, the invention relates to the use of a subframe mounted to the frame and connected with a blade portion of the blade assembly, the subframe including means associated therewith for angling the blade portion relative to the frame of the work machine.

BACKGROUND ART

It is well-known in the prior art to include an angle blade assembly that is attached to a frame of a work machine. In most instances, it is preferable that the angle blade assembly be close to the frame of the work machine to increase stability and ease of handling. In particular, angle blade assemblies are designed to perform various functions. Therefore, it is preferable that the angle blade assembly be capable of being raised, lowered, and angled relative to the frame of the work machine to perform the various functions. For example, angle blade assemblies are designed for bulldozing a flat surface wherein material is pushed in front of the angle blade assembly. In other configurations, the angle blade assemblies are designed so that a blade of the angle blade assembly can be angled in one direction or the other with respect to its travel path, thus, directing material to one side or the other of the travel path of the angle blade assembly. Angling of the blade of angle blade assembly, in particular, has been accomplished through the use of various types of subframes connected to the frame of the work machine. Typically, the subframes are operatively associated with a pair of hydraulic cylinders attached at a first end to opposite sides of the subframe and connected at a second end to the blade. The subframe is generally pivotally mounted to the blade via a connector of suitable design so that extension and retraction of the hydraulic cylinders results in the blade pivoting about the connector.

A design disclosed in U.S. Pat. No. 5,058,685 issued to John M. Moffitt on Oct. 22, 1991 utilizes an apparatus for mounting a dozer blade for vertical and angular movement relative to a frame of a wheeled implement. The mounting apparatus includes a mounting mechanism which allows the dozer blade to be mounted close to the wheels on either end of the implement. Further, the mounting mechanism permits angular movement of the blade about a generally vertical axis. The mounting apparatus includes a linearly distendable driver which extends laterally across the frame of the implement and an offset mounted linkage mechanism which improves angling moments and maximizes the driving force imparted to the blade upon extension of the driver. The linearly distendable driver and linkage mechanism operate in combination and in a closely defined area adjacent to the implement frame or effecting extended angular movement of the dozer lade. Unfortunately, the use of a linkage mechanism in conjunction with the linearly distendable driver increases the moving parts within the mounting apparatus, thereby, increasing complexity and costs. Additionally, the offset mounting of the linkage mechanism promotes unequal torque forces on opposing sides of the blade which lowers efficiency of the angling operation.

The present invention is directed to overcoming the problems as set forth above.

DISCLOSURE OF THE INVENTION

In one aspect of the present invention, a blade assembly is utilized which comprises a blade, a subframe, and an actuating cylinder. The subframe has a connecting portion with a pair of legs that extend from a defined midpoint. Additionally, the subframe has a lever portion with a first end connected at the midpoint of the connecting portion to define a primary vertical axis and a second end. The blade is connected with the first end of the lever portion for pivotal movement therewith. The actuating cylinder has a housing portion pivotally connected to the second end of the lever portion of the subframe to define a secondary vertical axis. Additionally, the actuating cylinder has a rod portion that extends through the housing portion to define first and second rod ends. The first rod end of the actuating cylinder is mounted to one of the pair of legs. The second rod end of the actuating cylinder is located adjacent the other of the one of the pair of legs. The housing portion is movable along the rod portion between the pair of legs to produce angular motion of the blade relative to the connecting portion of the subframe. The angular motion of the blade is produced through movement of the secondary vertical axis about the primary vertical axis.

In another aspect of the invention, a blade assembly is mounted on a frame of a work machine for angular movement relative to the frame. The blade assembly comprises a blade and connecting means for mounting the blade to the frame of the work machine in a manner permitting angular movement of the blade about a primary vertical axis. The connecting means has first and second end portions. Additionally, the blade assembly comprises a lever and an actuating cylinder. The lever has first and second ends with the first end connected between the connecting means and the blade to define the primary vertical axis. The primary vertical axis is located between the first and second end portions of the connecting means. The actuating cylinder has a housing portion pivotally connected to the second end of the lever to define a secondary vertical axis. The actuating cylinder also has a rod portion that extends through the housing portion to define first and second rod ends. The first rod end of the actuating cylinder is mounted to the first end portion of the connecting means. The second rod end of the actuating cylinder is located adjacent the second end portion of the connecting means. The housing portion is movable along the rod portion between the first and second end portions of the connecting means to produce angular motion of the blade relative to the frame of the work machine. The angular motion of the blade is produced through movement of the secondary vertical axis about the primary vertical axis.

In yet another aspect of the present invention, a blade assembly is mounted on a frame of a work machine for angular movement relative to the frame. The blade assembly comprises a blade, connecting means, a lever, and an actuating cylinder. The connecting means mounts the blade to the frame of the work machine in a manner permitting angular movement of the blade about a primary vertical axis. The connecting means has first and second end portions. The lever has first and second ends with the first end connected between the connecting means and the blade to define the primary vertical axis. The primary vertical axis is located between the first and second end portions of the connecting means. The actuating cylinder has a line of action, a housing portion pivotally connected to the second end of the lever, and a rod portion that extends through the housing portion to define first and second rod ends. The first rod end of the actuating cylinder is located adjacent the first end portion of the connecting means and the second rod end of the actuating cylinder is located adjacent the second end portion of the connecting means. The housing portion is movable along the rod portion between the first and second end portions of the connecting means to produce angular motion of the blade relative to the frame of the work machine. The line of action of the actuating cylinder maintains a substantially constant distance from a parallel line extending through the primary vertical axis throughout the angular motion of the blade.

The present invention includes a blade assembly capable of angular motion relative to a frame of a work machine. The blade assembly includes a blade, a subframe connected to the blade, and a actuating cylinder. The subframe includes connecting and lever portions that are uniquely connected to define a primary vertical axis. The actuating cylinder is uniquely connected to the connecting portion. Further, the actuating cylinder is uniquely connected to the lever portion to define a secondary vertical axis. The connection of the actuating cylinder to the connecting and lever portions and location of the actuating cylinder produces the angular motion of the blade when the actuating cylinder is operated. The ability to utilize a single actuating cylinder with minimal components to produce angular motions of the blade through movement of the secondary vertical axis about the primary vertical axis increases the efficiency of the design while lowering associated costs.

BEST MODE FOR CARRYING OUT THE INVENTION

Figure 1:
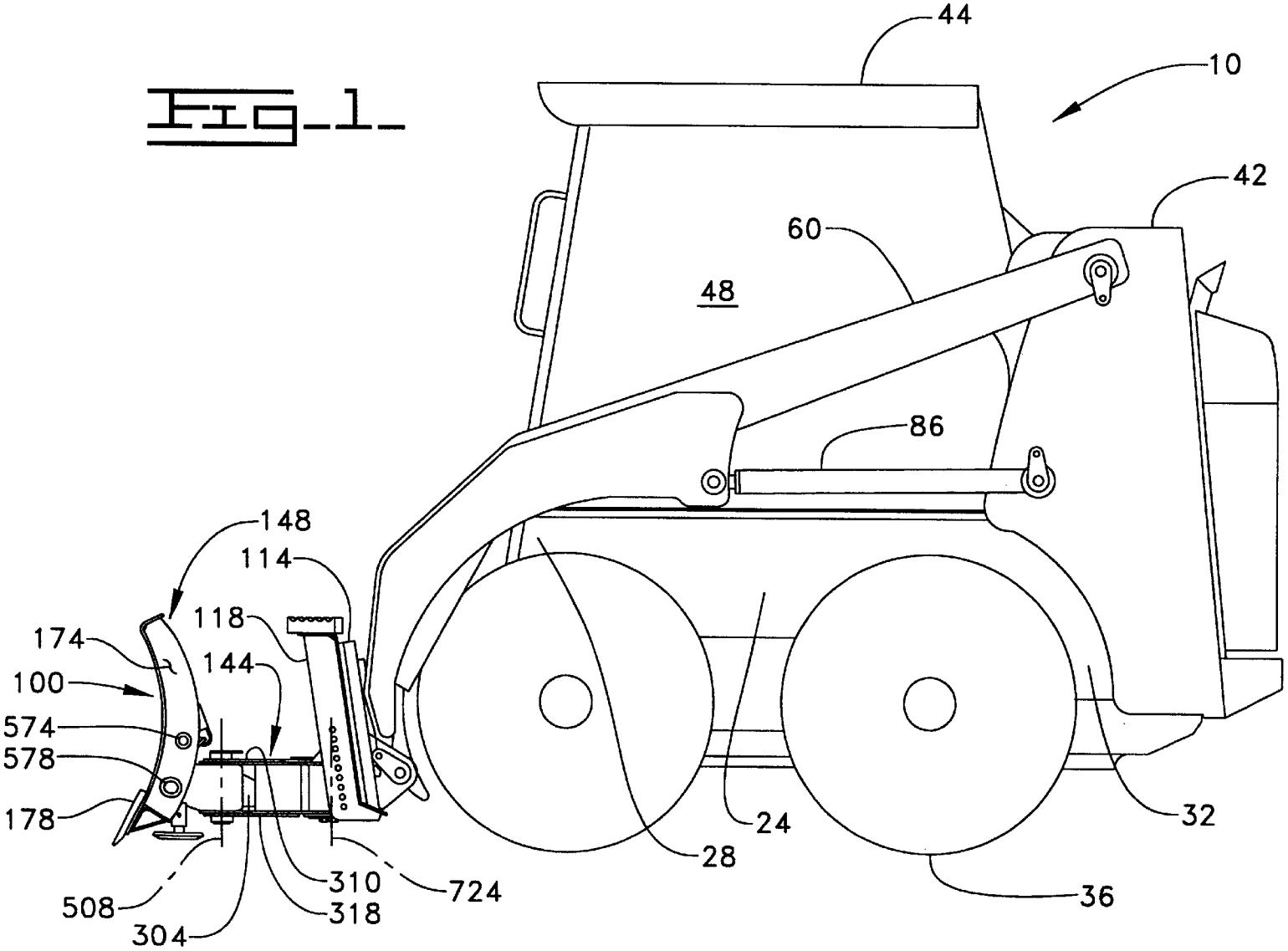
FIG. 1 is a partial side elevational view of a work machine having a coupler assembly for mounting the present invention angle blade assembly.
Figure 2:
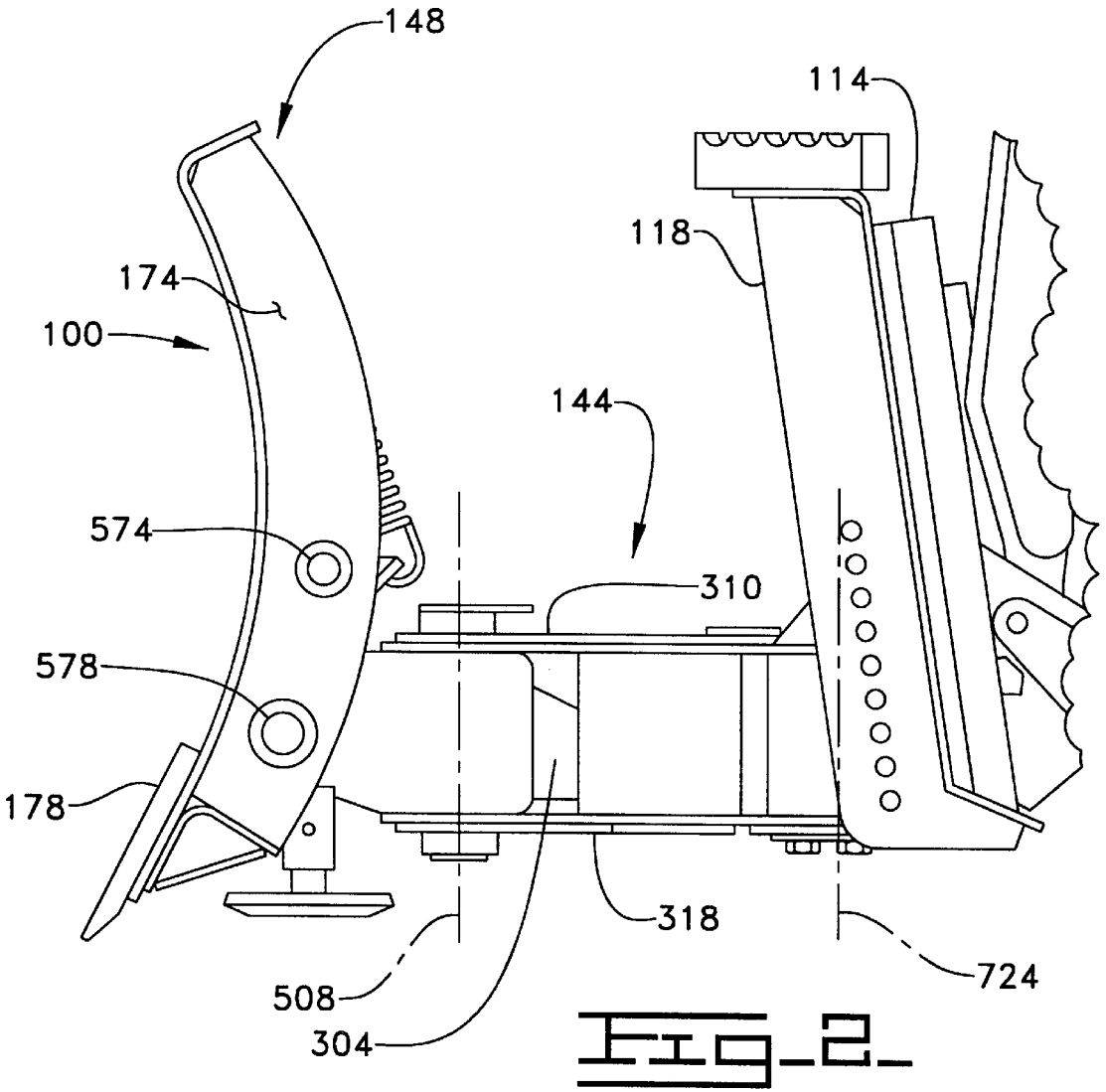
FIG. 2 is a partial side view of the present invention detailed in FIG. 1 shown detached from the work machine.
Figure 3:
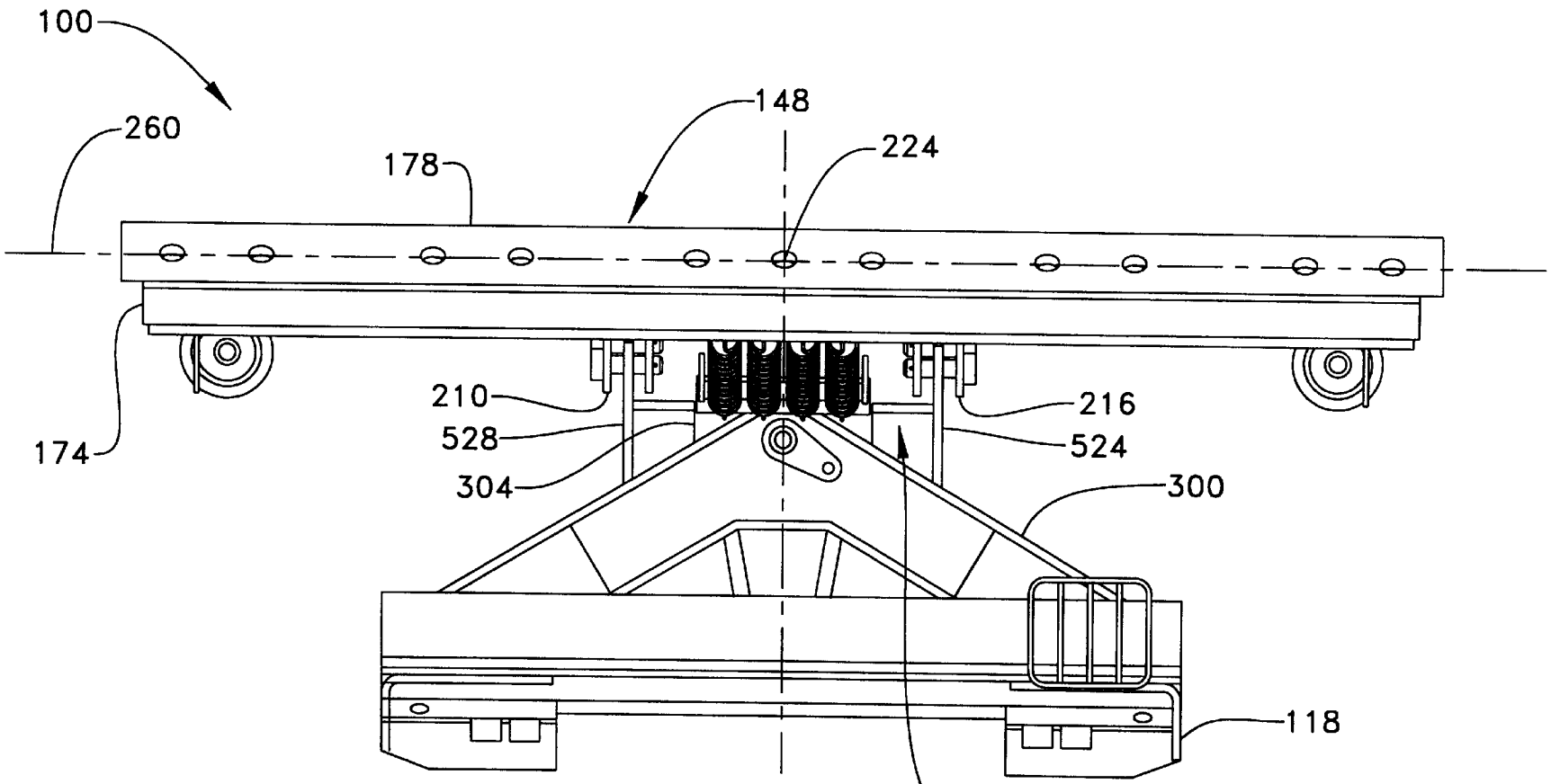
FIG. 3 is a top elevational view of the present invention.
Figure 4:
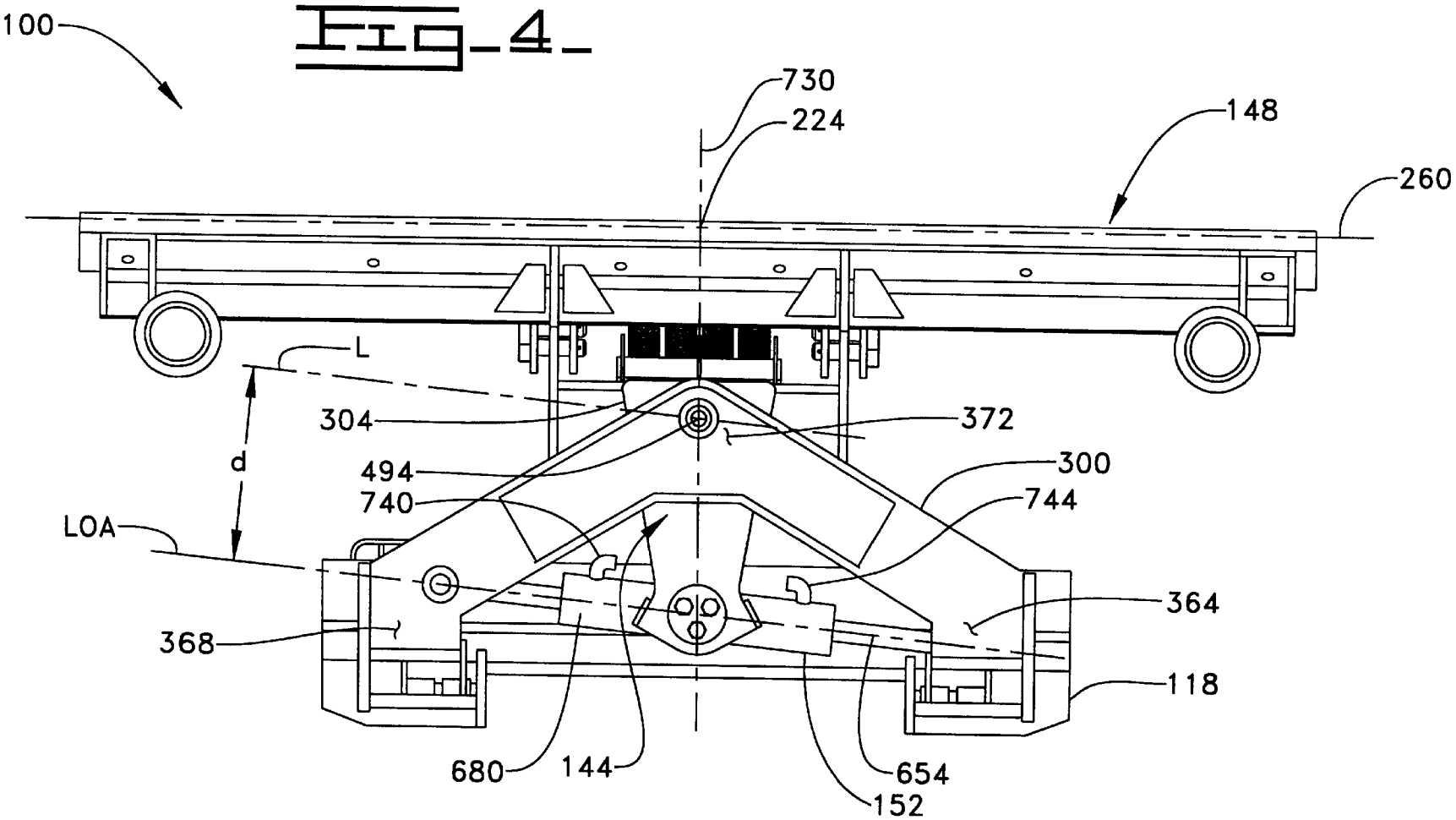
FIG. 4 is a bottom elevational view of the present invention showing a blade at a non-angled position.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 9:
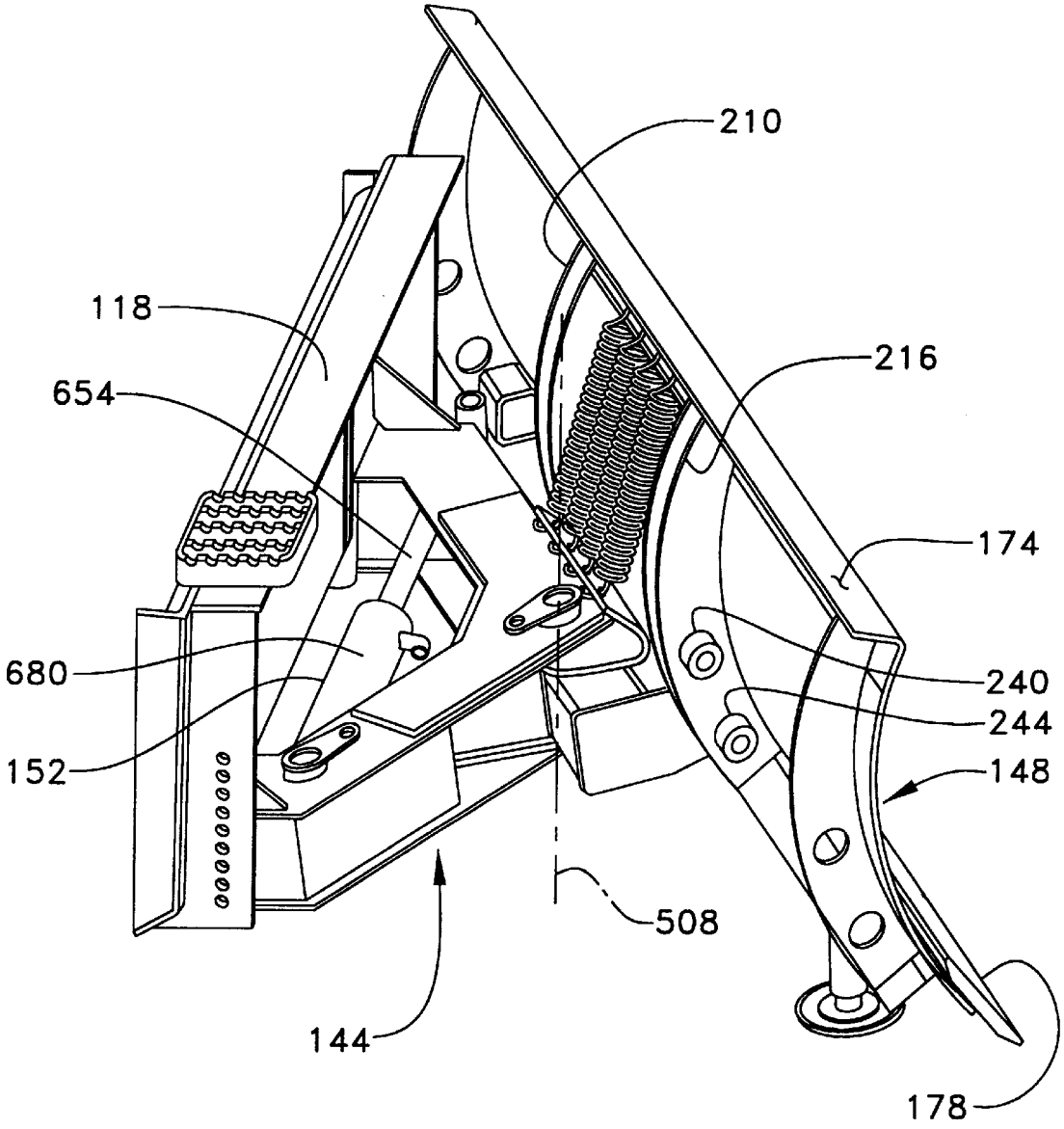
FIG. 9 is a partial perspective view of the present invention detailing the structures shown in FIG. 2.
Figure 10:
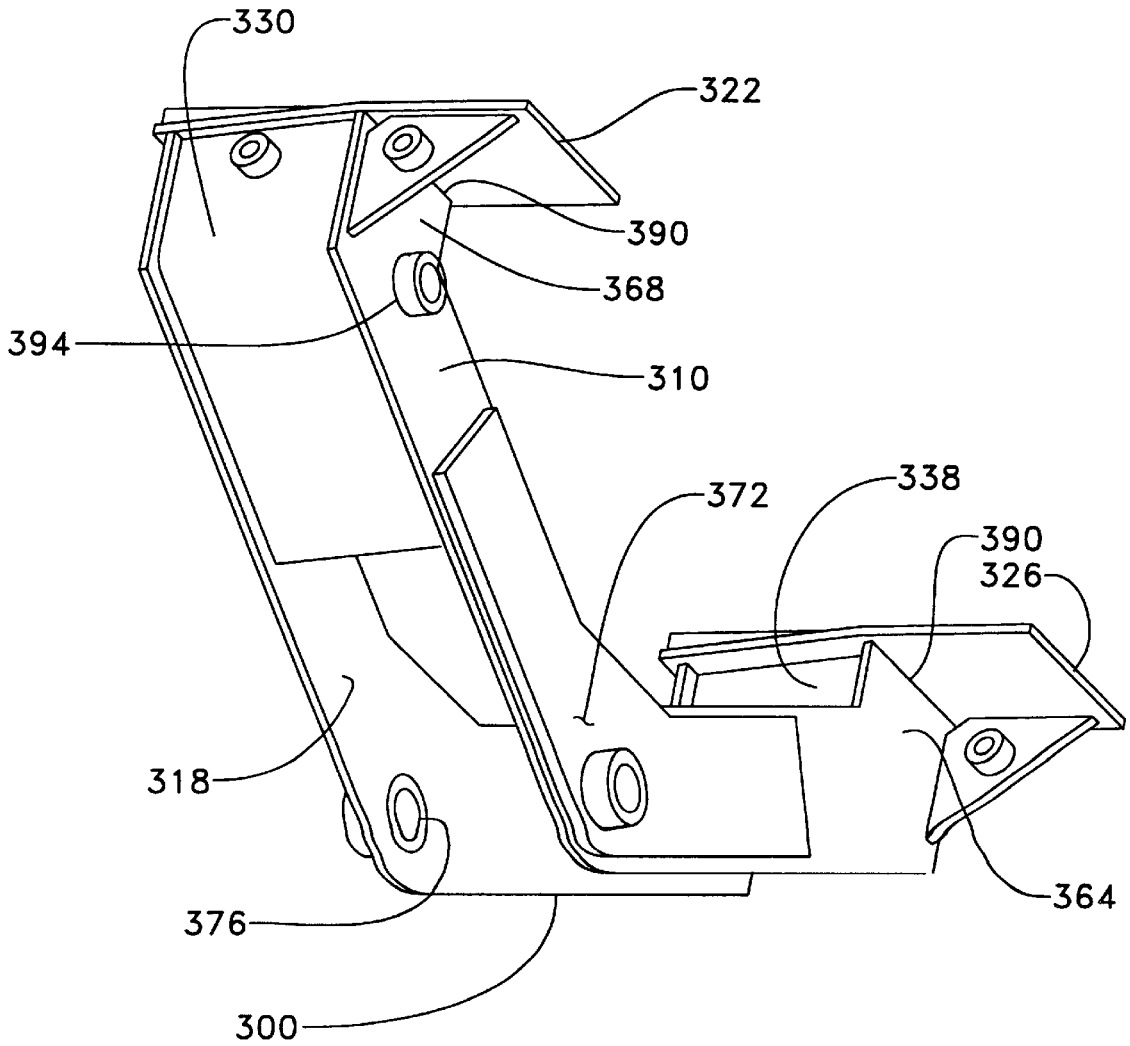
FIG. 10 is a perspective view of a connecting portion for a subframe of the present invention.

Referring to FIGS. 1, a work machine 10, such as a skid steer loader, is shown incorporating the present invention. The work machine 10 includes a frame 24 with front and rear end portions 28,32 supported by a plurality of wheels 36. The frame 24 includes left and right upright tower assemblies, one of which is shown at 42, that are positioned on the rear end portion 32 thereof. A cab 44 is mounted on the front end portion 28 of the frame 24 for partially enclosing an operator (not shown) within an operating compartment 48. Left and right liftarm assemblies, one of which is shown at 60, are pivotally mounted to the respective corresponding left and right tower assemblies 42 for movement between lowered and raised positions. A pair of any suitable type of lift actuators, one of which is shown at 86, are used to lower and raise the respective corresponding left and right liftarm assemblies 60. An attachment, such as a pivotal angle blade assembly 100, is connected to the frame 24 of the work machine 10 through a coupler 114 attached to the liftarm assemblies 60. It should be understood that the angle blade assembly 100 may be directly or indirectly attached to the coupler 114 or the frame 24 of the work machine 10 by one or more of a plurality of connecting means, such as an interface 118, shown more clearly in FIG. 9.

The angle blade assembly 100, seen more clearly in FIGS. 2–9, includes a subframe assembly 144, a blade assembly 148, and an actuating cylinder 152. The blade assembly 148 is mounted for pivotal movement with the subframe assembly 144 between right and left angled positions 162,168, respectively, shown in FIGS. 5 and 6, as referenced from a machine centerline (not shown). The blade assembly 148, seen best in FIGS. 7 and 9, includes a strengthening portion 174 and a blade 178 extending from the strengthening portion 174 in a conventional manner. The strengthening portion 174 has a plurality of structural members connected thereto including first and second pairs of curved connecting plates 210,216, respectively. Each of the pair of connecting plates 210,216 are located on opposite sides of a midpoint 224 (seen best in FIG. 3) of the blade 178 and extend rearwardly from the strengthening portion 174. Each of the pair of connecting plates 210,216 are spaced in such a manner to define a pair of pin openings therebetween 240,244. A tab assembly 250 is connected to the strengthening portion 174 and is located between the first and second pair of connecting plates 210,216. The tab assembly 250 includes a first plate 252 mounted in any suitable manner, such as through bolts 254, to the strengthening portion 174. A second plate 256 is connected to the first plate 252 in any suitable manner, such as welding, and is angled from the first plate 252 and extends outwardly therefrom. A plurality of openings 258 are defined through the second plate 256. The blade assembly 148 has a longitudinal axis 260 extending along the length of the blade 178, as seen in FIGS. 3–6.

Referring to FIGS. 2–11, the subframe 144 includes a substantially triangular shaped connecting portion 300 and a lever portion 304 connected between the connecting portion 300 and the blade assembly 148 in a manner detailed below. The connecting portion 300 is formed from upper and lower plates 310,318 joined by face plates 322,326, outer side plates, one of which is shown at 330, and inner side plates 334,338, seen more clearly in FIGS. 7–8 and 10. Inner side plate 334 includes a cut-out tab portion 340 that defines a space 352 between the inner side plate 334 and respective rear side plate 330. Referring to FIGS. 4–8 and 10, the plates 310,318 of the connecting portion 300 each have a pair of legs 364,368 which extend from a summit 372 at a location that defines a first coaxial pin opening 376 (seen best in FIG. 10) between the upper and lower plates 310,318 and terminate at a respective base 390. The pin opening 376 is located substantially at a midpoint between the pair of legs 364,368. A second coaxial pin opening 394 (seen best in FIGS. 7 and 10) is defined between the upper and lower plates 310,318 at leg 368 adjacent the space 352.

Figure 5:
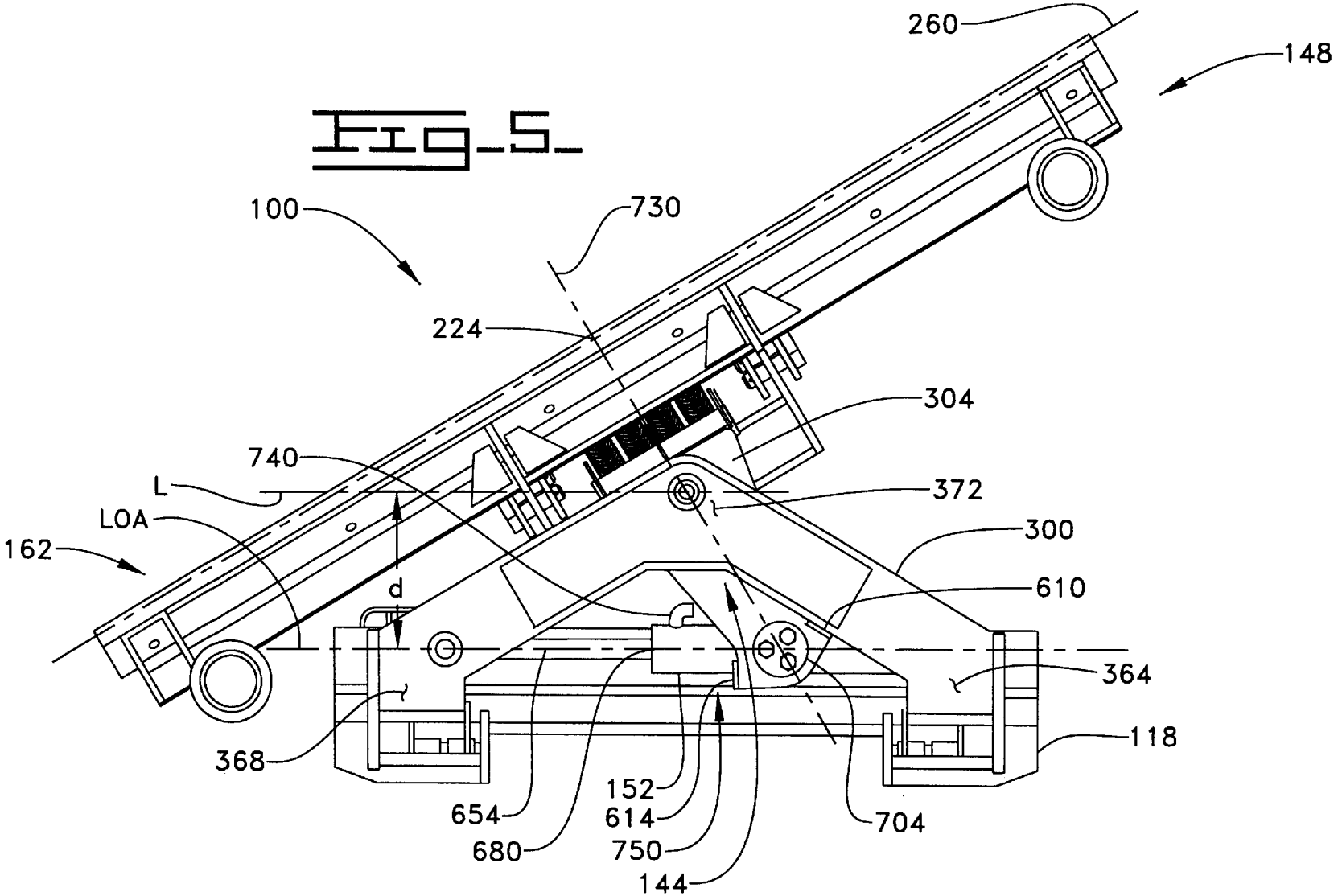
FIGS. 5 and 6 are bottom elevational views of the present invention showing the blade at extreme angled positions on either side of a centerline of the work machine.
Figure 6:
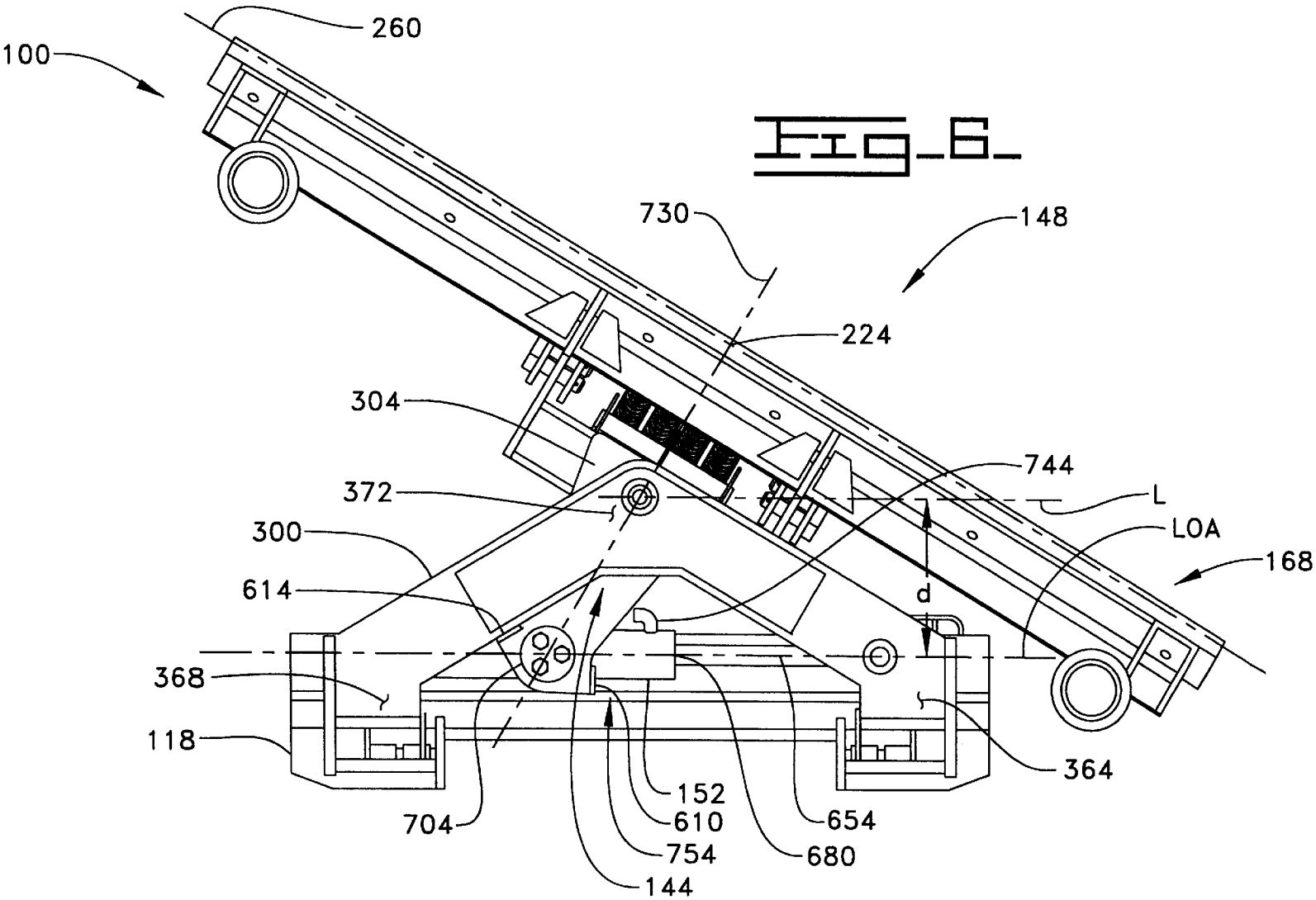
Figure 11:
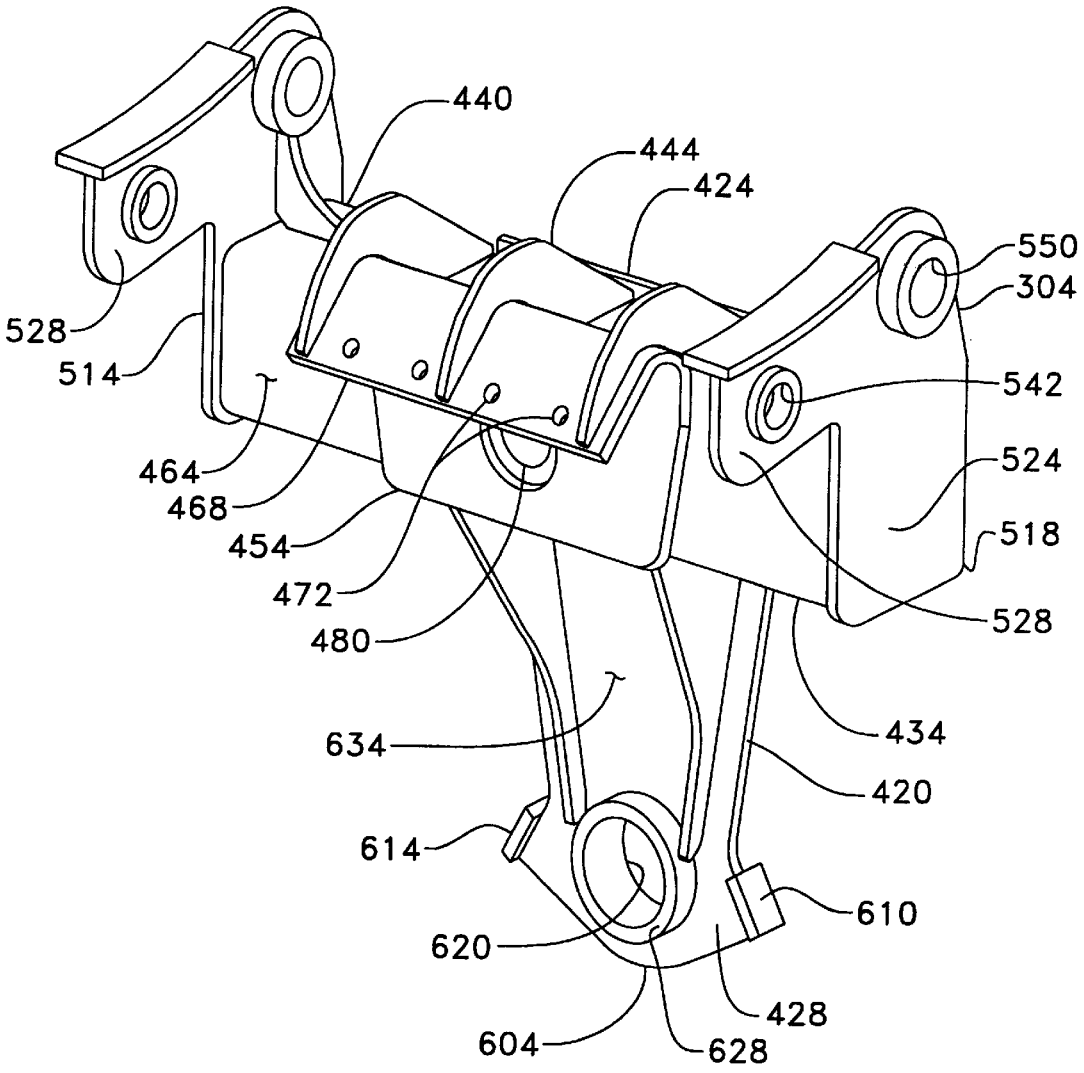
FIG. 11 is a perspective view of a lever portion for the subframe of the present invention.

Referring to FIGS. 1–9 and more specifically to FIG. 11, the lever portion 304 is formed substantially from a triangular shaped pivot plate 420 with base and summit end portions 424,428, respectively, and an elongated channel member 434 extending laterally across and connected at a lower surface 440 to the base end portion 424 of the pivot plate 420 to define a first end 444 of the lever portion 304. Included at the first end 444 of the lever portion 304 is a formed plate 454 connected at an upper surface 464 of the channel member 434. The formed plate 454 has a bent portion 468 extending upwardly away from the upper surface 464 of the channel member 434 with a plurality of openings 472 defined therethrough. A pin opening 480 is defined through the lever portion 304 which extends through the base end portion 424 of the pivot plate 420, the channel member 434, and formed plate 454. The lever portion 304 is partially disposed between the upper and lower plates 310, 318 of the connecting portion 300, as seen best in FIG. 1. A pin 494 extends through the pin openings 376,480 of the connecting and lever portion 300,304 to connect the lever portion 304 to the connecting portion 300 in a conventional pin joint design (seen best in FIGS. 4 and 7). The connection between the connecting and lever portions 300,304 defines a primary vertical axis 508 (seen in FIGS. 1 and 9). The primary vertical axis 508 is spaced from the longitudinal axis 260 of the blade assembly 148. A line "L" drawn through the primary vertical axis 508 is parallel with the line of action "LOA" of the actuating cylinder 152 (seen in FIGS. 4–6). The channel member 434 includes a pair of attachment plates 514,518 at opposite ends thereof. As seen more clearly in FIGS. 7 and 11, the attachment plates 514,518 have a general L-shape with a body portion 524 and arm portion 528 extending from the body portion 524 at a distance from the channel member 434. Locking pin and pivot pin openings 542,550 are defined coaxially through each of the body and arm portions 524,528 of the attachment plates 514,518, respectively. The attachment plates 514,518 are connected between a respective one of the pairs of connecting plates 210,216 by a pair of locking and pivot pins 574,578 extending through the respective pin openings 240,244,542,550 and held therein in any suitable manner so that the subframe 144 and blade assembly 148 are connected. The connection of the pins 574,578 through the pin openings 240,244,542,550 define respective locking and pivot pin joints 590,594. Additionally, the connection between the subframe 144 and the blade assembly 148 defines a spatial relationship between the blade 178 and channel member 434 with the blade 178 and channel member 434 positioned substantially parallel to one another, as seen in FIGS. 3–6. A spring trip mechanism 600, such as a plurality of biasing springs, extend between the blade assembly 148 and subframe 144, as seen best in FIG. 7. Each of the biasing springs 600 are connected at a first end 601 to one of the plurality of openings 258 in the second plate 256 of the tab assembly 250 and at a second end 602 to one of the plurality of openings 472 in the formed plate 454 of the lever portion 304 to allow for elevational adjustment between the ground (not shown) and the blade 178. Referring to FIGS. 5–6 and 11, the summit end portion 428 of the pivot plate 420 defines a second end 604 of the lever portion 304 and diverges outwardly to define a pair of opposed stops 610,614. A pin opening 620 is defined through the pivot plate 420 that extends through the summit end portion 428 and is disposed between the stops 610,614. A boss 628 circumferentially surrounds the pin opening 620 and extends outwardly from a lower surface 634 of the pivot plate 420.

Figure 7:
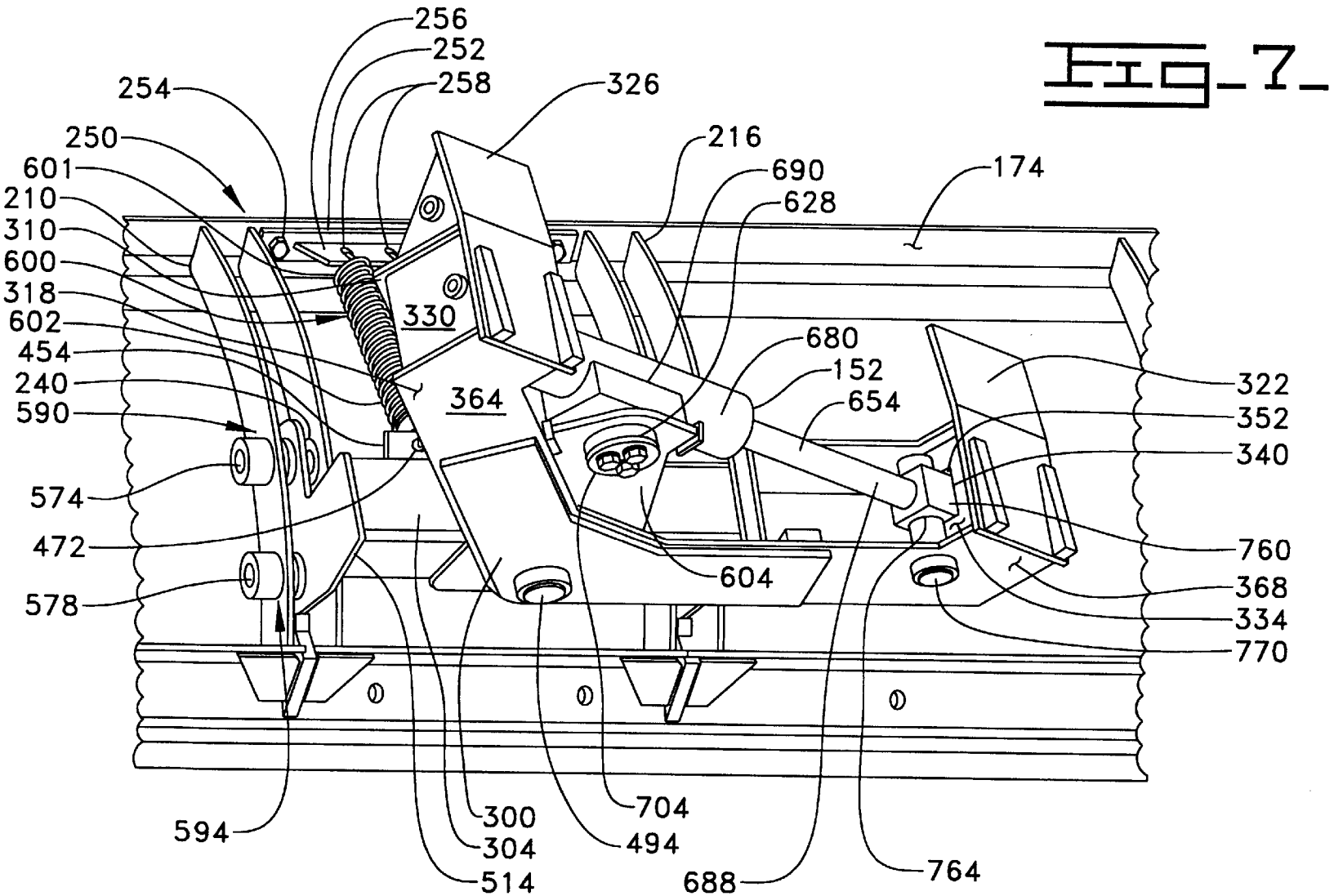
FIGS. 7 and 8 are partial perspective views of the present invention detailing the connection of an actuating cylinder thereof.
Figure 8:
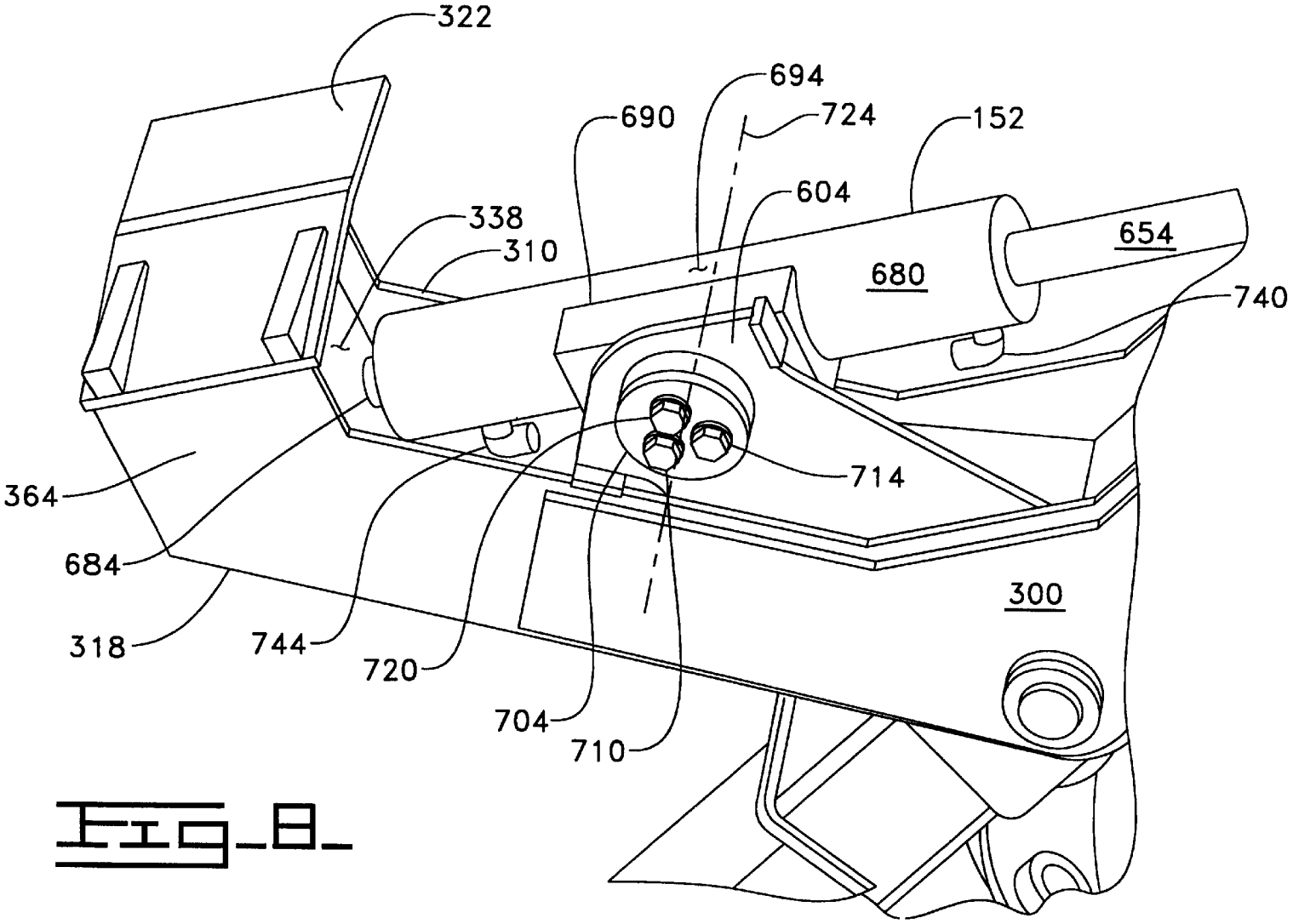

Referring to FIGS. 1 and 4–9, the actuating cylinder 152 is of a double acting design with a linearly distending rod portion 654 defining a line of action "LOA" and a housing portion 680 slidingly disposed along the rod portion 654. The rod portion 654 extends between the legs 364,368 of the connecting portion 300 and includes a free end 684, seen best in FIG. 8, and a connecting end 688, seen best in FIG. 7. Referring more specifically again to FIGS. 7–8, a mounting member 690 is connected in any suitable manner to the housing portion 680 at a central location 694 thereof. The mounting member 690 is connected to the second end 604 of the lever portion 304 by a pin (not shown) that extends through the pin opening 620. A cap 704 is seated on the boss 628 to hold the pin (not shown) within the pin opening 620 via a pair of bolts 710,714. The pin (not shown) is held in a fixed position with the cylinder 152 through any suitable means, such as a bolt 720 extending from the cap 704 and terminating within the mounting member 690. The connection between the mounting member 690 and the lever portion 304 defines a secondary vertical axis 724, seen in FIGS. 1 and 8. A plane 730 is defined that extends through the primary and secondary vertical axes 508,724 and is perpendicular with the longitudinal axis 260 of the blade 178, as seen best in FIGS. 4–6. The plane 730 intersects the blade 178 at its midpoint 224. A pair of supply fittings 740,744 are connected in a convention manner to the housing portion 680 at opposed sides of the central location 694. It should be understood that a supply of actuating fluid (not shown) is transferred from a source (not shown) on the work machine 10 to the supply fittings 740,744 via a respective pair of actuating lines (not shown) to move the housing portion 680 in a conventional manner between first and second positions 750,754 along the rod portion 654, seen respectively in FIGS. 5 and 6. As seen in FIG. 7, the connecting end 688 of the rod portion 654 has a connector 760 with a bore 764 therethrough. A portion of the connector 760 is disposed within the space 352 of the connecting portion 300 of the subframe 144 so that the bore 764 and pin opening 394 are coaxially aligned. A pin 770 extends through the pin opening 394 and bore 764 and is held therein in any suitable manner to connect the connecting end 688 of the rod portion 654 to the subframe 144 at a location adjacent the leg 368. As seen in FIG. 8, the free end 684 of the rod portion 654 is positioned proximate the inner side plate 338 adjacent the leg 364.

Industrial Applicability

During operation of the angle blade assembly 100 along the ground (not shown), it is desirable for the springs 600 between the blade assembly 148 and the subframe 144 to be enabled to function as a "trip" to cushion the blade 178 from excessive wear or damage when experiencing ground elevation variances. In order to accomplish this purpose, the springs 600 are connected between the blade assembly 148 and the subframe 144, as described above, and have a preset spring tension. The spring tension is preset by tightening the bolts 254 until the desired spring tension is achieved or in any suitable manner. Additionally, locking pin 574 is removed so that the blade assembly 148 is free to pivot about pivot pin 578. As the ground elevation varies, the springs 600 are tensioned or compressed accordingly as the blade assembly 148 pivots about pivot pin 578. When the angle blade assembly 100 operates to remove dirt and debris, it may be desirable to fix the blade assembly 148 and disable the "trip" capabilities. This is accomplished by re-inserting locking pin 574 through pin openings 240,542 of the blade assembly 148 and lever portion 304 of the subframe 144, respectively. The re-insertion of the locking pin 574 acts to fix the blade assembly 148 relative to the lever portion 304 of the subframe 144. The method of switching between an enabled or a disabled "trip" by removal or insertion, respectively, of the locking pin 574 allows for a quick transition without removal of the springs 600, saving time and energy for the operator (not shown).

The unique connection between the blade assembly 148, connecting and lever portions 300,304 of the subframe 144, and actuating cylinder 152 allows for the pivotal movement of the blade assembly 148 between the right and left angled positions 162,168, as seen in FIGS. 5 and 6, respectively. The pivotal movement is achieved when the operator (not shown) selects an angled position of the blade assembly 148 from inside the cab 44 of the work machine 10. Once the operator (not shown) selects the angled position of the blade assembly 148, a signal is produced which is operatively associated with solenoid valves (not shown), in a conventional manner, to direct a flow of actuating fluid (not shown) through the respective actuating lines (not shown) to the respective supply fitting 740,744 dependent upon the angled position selected. Referring to FIGS. 5 and 6, it should be understood that the addition of actuating fluid through either of the supply fittings 740,744 moves the housing portion 680 of the actuating cylinder 152 between the first and second positions 750,754 to facilitate the pivotal movement of the blade assembly 148. The movement of the housing portion 680 between the first and second positions 750,754 moves the secondary vertical axis 724 substantially about the primary vertical axis 508 so that a constant radius is maintained throughout the angular movement of the blade assembly 148. Throughout the angular movement of the blade assembly 148, the line of action "LOA" of the actuating cylinder 152 maintains a substantially constant distance "d" from the parallel line "L" drawn through the primary vertical axis 508, as seen best in FIGS. 4–6. The ability to substantially maintain the constant distance "d" allows for virtually identical forces to be exerted by the actuating cylinder 152 throughout the angular movement of the blade assembly 148. The ability to pivot the blade assembly 148 in the above manner increases the effectiveness of the design without utilization of complex linkages. More specifically, the singular actuating cylinder 152 works directly with surrounding structural components to achieve the pivotal movement of the blade assembly 148. As seen in FIG. 5, when the housing portion 680 reaches the first position 750, the stop 610 on the lever portion 304 contacts leg 364 in order to prevent further angular movement of the blade assembly 148. Similarly, as seen in FIG. 6, when the housing portion 680 reaches the second position 754, the stop 614 contacts leg 368. These stops 610,614 are provided to limit the pivotal movement of the blade assembly 148 to the most effective ranges of motion.

Other aspects, objects and advantages of this invention can be obtained from a study of the drawings, disclosure and the appended claims.

What is claimed is:

1. A blade assembly, comprising:

a blade;

a subframe having a connecting portion with a pair of legs extending from a defined midpoint and a lever portion having a first end connected at the midpoint of the connecting portion to define a primary vertical axis and a second end, the blade being connected with the first end of the lever portion for pivotal movement therewith; and an actuating cylinder having a housing portion pivotally connected to the second end of the lever portion of the subframe to define a secondary vertical axis and a rod portion extending through the housing portion to define first and second rod ends, the first rod end of the actuating cylinder being connected to one of the pair of legs and the second rod end of the actuating cylinder located adjacent the other of the one of the pair of legs, the housing portion being movable along the rod portion between the pair of legs to produce angular motion of the blade relative to the connecting portion of the subframe through movement of the secondary vertical axis about the primary vertical axis.

2. The blade assembly of claim 1, wherein the actuating cylinder has a line of action, the secondary vertical axis maintains a constant radius about the primary vertical axis throughout the angular motion of the blade, and the line of action of the actuating cylinder maintains a substantially constant distance from a parallel line extending through the primary vertical axis throughout the angular motion of the blade.

3. The blade assembly of claim 2, wherein maintaining the substantially constant distance between the line of action of the actuating cylinder and the parallel line extending through the primary vertical axis allows substantially equal forces to be exerted by the actuating cylinder to achieve the angular motion of the blade.

4. The blade assembly of claim 1, wherein the housing portion of the actuating cylinder has a central portion and the pivotal connection between the housing portion of the actuating cylinder and the second end of the lever portion of the subframe is located at the central portion.

5. The blade assembly of claim 6, wherein the connection of the actuating cylinder to the connecting and lever portions of the subframe facilitates the movement of the housing portion of the actuating cylinder along the rod portion in a manner that allows substantially equal forces to be exerted by the actuating cylinder to achieve the angular motion of the blade.

6. The blade assembly of claim 1, wherein the blade has a longitudinal axis and a plane is defined by the primary and secondary vertical axes which is perpendicular to the longitudinal axis throughout the angular motion of the blade, the plane intersects the blade at a substantial midpoint therealong and is located between the legs of the connecting portion.

7. The blade assembly of claim 1, wherein a stop is connected to the lever portion of the subframe and adapted for abutment with one of the pair of legs of the connecting portion dependent upon the angular position of the blade.

8. A blade assembly mounted on a frame of a work machine for angular movement relative to the frame, the blade assembly comprising:

a blade;

connecting means for mounting the blade to the frame of the work machine in a manner permitting angular movement of the blade about a primary vertical axis, the connecting means having first and second end portions;

a lever having first and second ends with the first end connected between the connecting means and the blade to define the primary vertical axis, the primary vertical axis being located between the first and second end portions of the connecting means;

an actuating cylinder having a housing portion pivotally connected to the second end of the lever to define a secondary vertical axis and a rod portion extending through the housing portion to define first and second rod ends, the first rod end of the actuating cylinder being mounted to the first end portion of the connecting means and the second rod end of the actuating cylinder located adjacent the second end portion of the connecting means, the housing portion being movable along the rod portion between the first and second end portions of the connecting means to produce angular motion of the blade relative to the frame of the work machine through movement of the secondary vertical axis about the primary vertical axis.

9. The blade assembly of claim 8, wherein the actuating cylinder has a line of action, the secondary vertical axis maintains a constant radius about the primary vertical axis throughout the angular motion of the blade, and the line of action of the actuating cylinder maintains a substantially constant distance from a parallel line extending through the primary vertical axis throughout the angular motion of the blade.

10. The blade assembly of claim 9, wherein maintaining the substantially constant distance between the line of action of the actuating cylinder and the parallel line extending through the primary vertical axis allows substantially equal forces to be exerted by the actuating cylinder to achieve the angular motion of the blade.

11. The blade assembly of claim 8, wherein the housing portion of the actuating cylinder has a central portion and the pivotal connection between the housing portion of the actuating cylinder and the second end of the lever is located at the central portion.

12. The blade assembly of claim 11, wherein the connection of the actuating cylinder to the connecting means and lever facilitates the movement of the housing portion of the actuating cylinder along the rod portion in a manner that allows substantially equal forces to be exerted by the actuating cylinder to achieve the angular motion of the blade.

13. The blade assembly of claim 8, wherein the blade has a longitudinal axis and a plane is defined by the primary and secondary vertical axes which is perpendicular to the longitudinal axis throughout the angular motion of the blade, the plane intersects the blade at a substantial midpoint therealong and is located substantially between the first and second end portions of the connecting means.

14. The blade assembly of claim 8, wherein a stop is connected to the lever and adapted for abutment with either the first or second end portion of the connecting means when the blade is moved to a predetermined angular position.

15. A blade assembly mounted on a frame of a work machine for angular movement relative to the frame, the blade assembly comprising:

a blade;

connecting means for mounting the blade to the frame of the work machine in a manner permitting angular movement of the blade about a primary vertical axis, the connecting means having first and second end portions;

a lever having first and second ends with the first end connected between the connecting means and the blade to define the primary vertical axis, the primary vertical axis being located between the first and second end portions of the connecting means; and an actuating cylinder with a line of action, the actuating cylinder having a housing portion pivotally connected to the second end of the lever and a rod portion extending through the housing portion to define first and second rod ends, the first rod end of the actuating cylinder being located adjacent the first end portion of the connecting means and the second rod end of the actuating cylinder located adjacent the second end portion of the connecting means, the housing portion being movable along the rod portion between the first and second end portions of the connecting means to produce angular motion of the blade relative to the frame of the work machine, and the line of action of the actuating cylinder maintaining a substantially constant distance from parallel line extending through the primary vertical axis throughout the angular motion of the blade.

* * * * *

UNITED STATES PATENT AND TRADEMARK OFFICE

CERTIFICATE OF CORRECTION

PATENT NO. : 6,109,363
DATED : August 29, 2000
INVENTOR(S) : Bradley R. High

It is certified that error appears in the above-identified patent and that said Letters Patent is hereby corrected as shown below:

Claim 5 Column 8,
Line 28, change "claim 6" to -- claim 4 --

Signed and Sealed this

Fourth Day of September, 2001

*Attest:*

Nicholas P. Godici

*Attesting Officer*

NICHOLAS P. GODICI
*Acting Director of the United States Patent and Trademark Office*